US005107181A

United States Patent [19]

Tsuzurahara

[11] Patent Number: 5,107,181

[45] Date of Patent: Apr. 21, 1992

[54] MAGNETRON

[75] Inventor: Mamoru Tsuzurahara, Mobara, Japan

[73] Assignee: Hitachi, Ltd., Tokyo, Japan

[21] Appl. No.: 518,994

[22] Filed: May 4, 1990

[30] Foreign Application Priority Data

May 19, 1989 [JP] Japan ..... 1-124325

[51] Int. Cl.[5] ..... H01J 23/15

[52] U.S. Cl. ..... 315/39.51; 315/39.63

[58] Field of Search ..... 333/181, 182, 183; 315/39.51, 39.53, 39.77, 39.75, 39.63, 39.67; 361/302, 274

[56] References Cited

U.S. PATENT DOCUMENTS 3,846,667 11/1974 Hisada et al. ..... 315/39.51 X
4,163,175 7/1979 Tashiro ..... 315/39.75 X
4,705,989 11/1987 Takada et al. ..... 315/39.51

FOREIGN PATENT DOCUMENTS 0012446 1/1989 Japan ..... 315/39.51
0041145 2/1989 Japan ..... 315/39.51
0044630 2/1990 Japan ..... 315/39.51

*Primary Examiner*—Eugene R. LaRoche
*Assistant Examiner*—Seung Ham
*Attorney, Agent, or Firm*—Antonelli, Terry, Stout & Kraus

[57] ABSTRACT

A magnetron cathode structure, including one or separate ceramic members having two openings therethrough with an electrical lead passing through each opening. A metallized section is formed on the interior surface of each opening, and another metallized section is formed on the exterior surface of each ceramic member to cause the respective metallized sections to form electrodes of first and second condensers. A resilient metal buffer member seals each electrical lead to the metallized section of that lead's respective opening. The resilient metal buffer members absorb thermal stress resulting from a difference in the coefficients of thermal expansion of the respective metallized section and the associated ceramic member. A metal outer frame member is sealed to the other metallized sections.

12 Claims, 3 Drawing Sheets

MAGNETRON

BACKGROUND OF THE INVENTION

The present invention relates to a magnetron which makes use of the magnetron cathode supporting ceramic stem as a dielectric for a capacitor for a microwave leakage preventive filter.

Recently, an electronic range for dielectrically heating food by generating microwaves has become widespread for domestic use. However, in the event the microwaves generated in the magnetron leak on the power supply side through the lead wires of the cathode of the magnetron, any electronic equipment positioned near the electronic range is adversely affected by noise. In order to prevent this, it has been the practice that a filter, comprising a choke coil and a capacitor, is provided at the input section of the cathode so as to interrupt the microwaves. Such a filter, it is described in Japanese Patent Publication No. 51-7394 with the lead wires of the magnetron supported by the bottom surface of a bottomed-cylindrical ceramic member serving as a cathode supporting stem, and the inner and outer cylindrical surfaces of the ceramic member are metallized to thereby form a capacitor. At the same time, in Japanese Laid-Open Patent Publication No. 50-126160, there is described a structure such that the cathode supporting stem is enclosed by a dielectric cylindrical member, except the terminal section of the cathode and the connection of the cathode terminal and the metallic wall of the tube is metallized to thereby form a through-capacitor. Further, in Japanese Laid-Open Patent Publication No. 55-165547 there is described a structure in which a second cathode support made of a rodlike magnetic body is helically surrounded by a first cathode support so as to form a choke coil, and a tubular dielectric is disposed between these cathode supports and a metallic sealing member surrounding the cathode supports to thereby form a capacitor. In addition, Japanese Laid-Open Patent Publication No. 63-293809 discloses a structure in which a capacitor is formed at the stem portion of the cathode.

FIGS. 1 and 2 respectively show prior art examples described in the above-mentioned Japanese Laid-Open Patent Publication No. 63-293809. In particular, FIG. 1 shows a capacitor in section formed by metallizing the bottom surface of a bottomed-cylindrical ceramic member wherein reference numeral 1 designates a ceramic material as a dielectric, reference numerals 3 and 4 designate cathode leads, reference numerals 11 and 12 designate metallized sections, and reference numeral 7 designates a metallic body forming an enclosure. The metallized section 11 is divided into two regions electrically insulated from each other and electrically connected to the cathode leads 3 and 4, respectively. The metallized section 12 is electrically connected to the metallic body 7 and is kept insulated from the two cathode leads.

FIG. 2 shows a capacitor structure formed at the side surface of a cylindrical ceramic member wherein the metallized section 11 is divided into two regions which are electrically conductive with the cathode leads 3 and 4, respectively. The metallized section 12 is electrically conductive with the metallic body 7 and forms a capacitor together with the metallized section 11, with the ceramic member 13 sandwiched therebetween.

However, of the above prior art examples, those disclosed in Publications Nos. 50-126160 and 55-165547 have complicated structures, each including a number of parts so that they are not suitable for practical use.

Further, those disclosed in Publications Nos. 51-7394 and 63-293809 have problems in respect of their reliability of sealing at the cathode lead section.

SUMMARY OF THE INVENTION

Accordingly, an object of the present invention is to provide a magnetron having a structure such that a buffer capable of absorbing the difference in the coefficients of thermal expansion between a metal and a ceramic mateial is interposed between each of the two cathode leads and the inner metallized surfaces of two cylindrical hollow ceramic members as dielectrics and is brazed thereto with a high degree of reliability of connection, and further, one or more dielectric members are assembled in a simple manner to thereby impart a filtering capacity to the cathode supporting stem.

In order to achieve the above object, there is employed in the present invention a funnel-shaped metal fitting made of a thin metallic plate and having a small-diameter portion at one end thereof and a funnel-shaped or skirtlike large-diameter portion at the other end thereof such that the small-diameter portion of the metal fitting is fitted about each of the two cathode leads and vacuum-sealed to the leads while the large-diameter portion thereof is brazed to the metallized part of the inner peripheral surface of each of the cylindrical hollow ceramic members so that thermal stress generated as a result of the difference in the coefficients of thermal expansion between the metallized part of the inner peripheral surface of each of the ceramic members and the ceramic member is compensated for by a slight deformation of the funnel-shaped metal fitting, and the reliability of the vacuum-sealed connection of each lead and each ceramic member is improved.

Thus, with the above structure, thermal stress generated at the sealed section between each of the leads and the ceramic stem due to the difference in the coefficients of thermal expansion is absorbed as an elastic deformation of a conical section of the comparatively thin metal fitting interposed between the two. In this case, unlike the use of a mere ringlike metal fitting, the deformation takes place moderately over a comparatively large area of the metal fitting so that no excessive stress is applied on the metal fitting, and the degree of deformation can be kept within its elastic deformable range. Further, as will be described hereunder, in the case of the present invention, the one end portion of the cylindrical hollow ceramic member which is outside the magnetron tube is left unmetallized for example for a distance of of least 7 mm., because that portion serves to enlarge the so called creeping distance of the surface of the ceramic member to thereby sharply improve the voltage withstanding property of the outside of the magnetron tube, which is much inferior to that of the inside thereof.

DESCRIPTION OF PREFERRED EMBODIMENT

Figure 1:
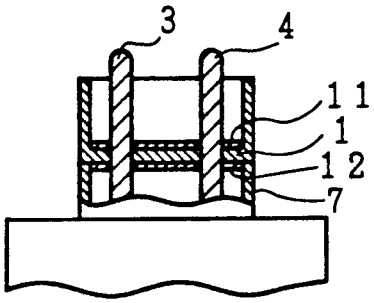
FIG. 1 (PRIOR ART)
FIG. 1 is a vertical sectional view of a conventional magnetron having a capacitor at the cathode supporting stem thereof.
Figure 2:
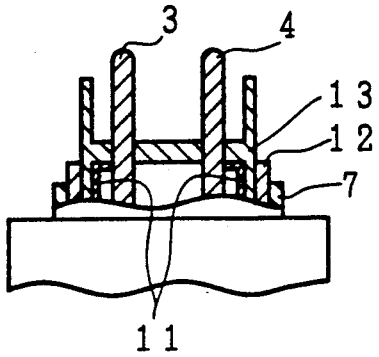
FIG. 2 (PRIOR ART)
FIG. 2 is a vertical sectional view of another conventional magnetron having a capacitor near the cathode supporting stem thereof.
Figure 3:
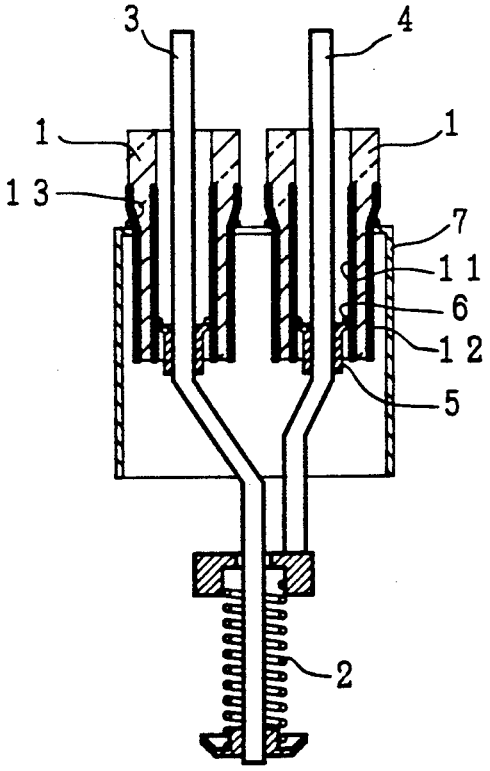
FIG. 3 is a vertical sectional view of a magnetron as a first embodiment of the present invention.

In FIG. 3, which is a vertical sectional view of an essential part of a magnetron as one embodiment of the present invention, reference numerals 1, 1 designate cylindrical hollow ceramic members each used as a dielectric of a capacitor for forming a microwave preventing filter. The inner and outer peripheral surfaces of each of the ceramic members 1, 1 include metallized sections 11 and 12, respectively, so that coaxial capacitors having electrodes formed by these metallized sections are formed. Further, into the cylindrical hollow ceramic members there are respectively inserted along the axes thereof a center lead 3 and a side lead 4 to feed electric current to a cathode 2, and funnel-shaped metal fittings 5, 5 are respectively fitted about the leads 3, and 4 with the small-diameter sections of the fittings being sealably fixed to the respective leads and the large-diameter sections thereof being vacuum-sealed to the metallized sections 11 which is fabricated on the inner surfaces of the cylindrical ceramic members. In addition, the outer peripheral surface of each of the cylindrical ceramic members 1, 1 has a stepped portion 13 which comes into engagement with a bottomed cylindrical metallic sealing member 7 of a magnetron vacuum enclosure when the cylindrical ceramic members are respectively inserted into holes drilled in the metallic sealing member 7. In this case, as the upper portion of each of the ceramic members is not metallized, for example for a distance of at least 7 mm., sufficient electrical insulation can be maintained between the lead 3 or 4 and the outer peripheral surface of the ceramic member. Further, the funnel-shaped metal fitting 5 fixed to the lead 3 or 4 is positioned properly by a lower bent portion of the lead.

Figure 4:
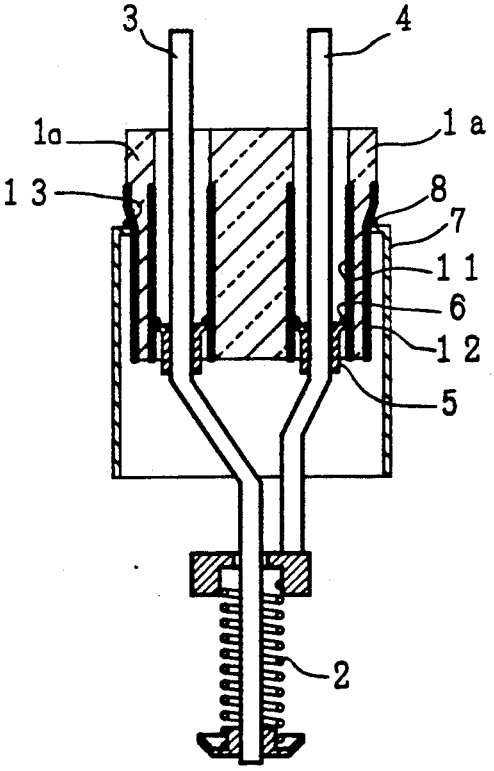
FIG. 4 is a vertical sectional view of a magnetron as a second embodiment of the invention.

FIG. 4 is a vertical sectional view of an essential portion of a magnetron as a second embodiment of the present invention. Unlike the first embodiment which employs two cylindrical hollow ceramic members 1*a*, this embodiment employs a single cylindrical ceramic member 1*a* having an elliptical cross-section and provided with two through-holes, but the remaining parts are the same as those of the first embodiment.

One of the merit of this embodiment is that the space between the leads 3 and 4 can be reduced and therefore, the embodiment is suitable for small sized supporting stem.

Figure 5A:
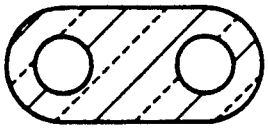
FIGS. 5(*a*) and 5(*b*) are examples of cross-sectional views of the ceramic members shown in FIG. 4.
Figure 5B:
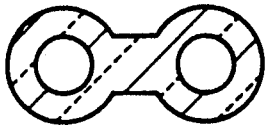

In FIGS. 5*a* and 5*b*, there are shown in section two examples of cathode supporting ceramic stems used in the instant embodiment which respectively serve as dielectrics.

Figure 6:
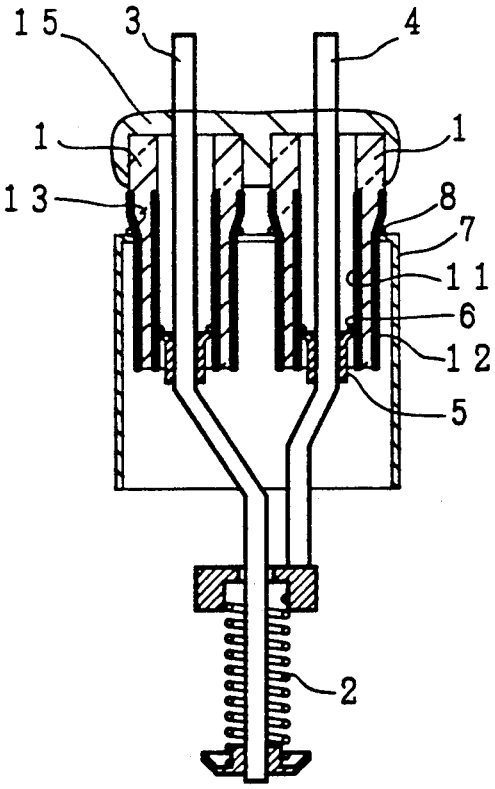
FIG. 6 is a vertical sectional view of a magnetron as a third embodiment of the invention.

FIG. 6 is a vertical sectional view of the first embodiment of the present invention especially when the cathode leads 3 and 4 and the outer peripheries of the ceramic members are coated with an electrically insulating resin material 15. These resin coatings keep the leads 3 or 4 more securely insulated from the outer metallized section 12 of each of the ceramic members.

Figure 7:
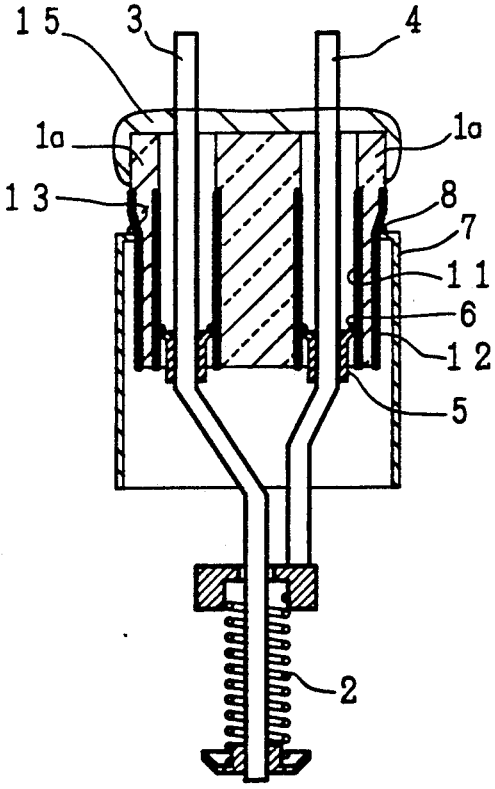
FIG. 7 is a vertical sectional view of a magnetron as a fourth embodiment of the invention.

Likewise, FIG. 7 is a vertical sectional view of the second embodiment of the present invention especially when the cathode leads and the outer periphery of the ceramic member are coated with an electrically insulating resin material 15. In FIGS. 6 and 7, the parts like those shown the other FIGS. 3 and 4, respectively, are designated by like reference numerals. Further, the embodiment of FIG. 7 is designed to achieve the same object as the other embodiments of the present invention.

Figure 8:
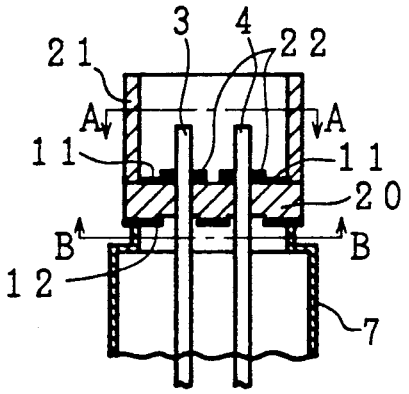
FIG. 8 is a vertical sectional view of a magnetron as a fifth embodiment of the invention.

FIG. 8 is a further embodiment of the present invention wherein reference numeral 20 designates a stem comprising a ceramic plate having a preferred height of at least 7 mm., reference numeral 21 designates a cylinder made of an insulating material and reference numeral 22 designates a buffer for absorbing thermal distortion generated between the cathode leads and the ceramic member, with the remaining parts like those shown in the other figures being designated by like reference numerals.

In FIG. 8, the metallized section 12 is in engagement with the metallic enclosure 7, and the cathode leads 3 and 4 are electrically insulated from each other. Further, the metallized section 11 is divided into two electrically insulated regions each of which is electrically conductive with the associated lead 3 or 4.

Further, the metallized sections 11 and 12 form a capacitor across the ceramic plate 20.

In addition, insulating cylinders 21 are provided for the purpose of making the metallized section 12 more securely insulated from the metallized section 11 by enlarging the creeping distance between the outer sides of the sections 12 and 11. The reason why the insulating cylinder 21 and the ceramic plate 20 are formed separately instead of integrating them is that by so doing, the workability of metallization is improved.

Likewise, the reason why the distance between the cathode leads 3 or 4 and the metallized section 12 is not made specifically large is that when the magnetron is in operation, the interior of the metallic enclosure 7 is evacuated, and the electrical insulating property of the creeping surface thereof becomes sufficiently high.

Figure 9A:
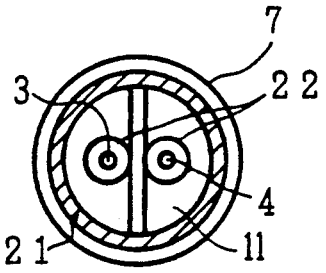
FIGS. 9(*a*) and 9(*b*) are section views of the magnetron taken at line A—A and line B—B of FIG. 8 respectively.
Figure 9B:
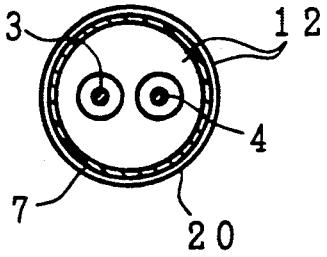

FIG. 9(*a*) is a sectional view taken along the A—A line of FIG. 8, and FIG. 9(*b*) is a view taken along the B—B line of FIG. 8. In these two figures, parts like those shown in FIG. 8 are the designated by the same reference numerals.

As described above, it is possible with the present invention to provide an improved magnetron which is highly reliable in respect to its vacuum sealing and electrical insulation and in which a cathode supporting insulating ceramic stem is utilized as a filter capacitor for preventing microwave leakage.

What is claimed is:

1. A magnetron cathode structure comprising:

a first hollow cylindrical ceramic member;

a second hollow cylindrical ceramic member;

a first electrical lead passing through the first ceramic member;

a second electrical lead passing through the second ceramic member;

a first metallized section formed on the interior cylindrical wall of said first ceramic member;

a second metallized section formed on the exterior cylindrical wall of said first ceramic member to cause said first and second metallized sections to form electrodes of a first condenser;

a third metallized section formed on the interior cylindrical wall of said second ceramic member;

a fourth metallized section formed on the exterior cylindrical wall of said second ceramic member to cause said third and fourth metallized sections to form electrodes of a second condenser;

a first resilient metal buffer member sealing said first lead to said first metallized section for absorbing thermal stress resulting from a difference in the coefficients of thermal expansion of said first metallized section and said first ceramic member;

a second resilient metal buffer member sealing said second lead to said third metallized section for absorbing thermal stress resulting from a difference in the coefficients of thermal expansion of said third metallized section and said second ceramic member; and a metallic outer frame member sealed to said second and fourth metallized sections.

2. A magnetron cathode structure as claimed in claim 1, wherein each of said first and second ceramic members has a first end adjacent said metallic outer frame member and a second end remote from said metallic outer frame member, and each of said metallized sections is formed on the first end of the respective ceramic members, with the second ends of said ceramic members being free of said metallized sections.

3. A magnetron cathode structure as claimed in claim 2, wherein each of said second ends extends for a distance of 7 mm.

4. A magnetron cathode structure as claimed in claim 1, wherein each of said buffer members is funnel shaped and is formed of thin metal.

5. A magnetron cathode structure as claimed in claim 2, further comprising an insulating resin member coated over said second ends.

6. A magnetron cathode structure comprising:

a cylindrical ceramic member having first and second parallel openings extending longitudinally therethrough;

a first electrical lead passing through the first opening;

a second electrical lead passing through the second opening;

a first metallized section formed on the interior wall of the first opening;

a second metallized section formed on the interior wall of the second opening;

a third metallized section formed on the exterior cylindrical wall of said ceramic member to cause said first and third metallized sections to form electrodes of a first condenser and said second and third metallized sections to form electrodes of a second condenser;

a first resilient metal buffer member sealing said first lead to said first metallized section for absorbing thermal stress resulting from a difference in the coefficients of thermal expansion of said first metallized section and said ceramic member;

a second resilient metal buffer member sealing said second lead to said second metallized section for absorbing thermal stress resulting from a difference in the coefficients of thermal expansion of said second metallized section and said ceramic member; and a metallic outer frame member sealed to said third metallized section.

7. A magnetron cathode structure as claimed in claim 6, wherein said ceramic member has a first end adjacent said metallic outer frame member and a second end remote from said metallic outer frame member, and each of said metallized sections is formed on the first end of said ceramic member, with the second end of said ceramic member being free of said metallized sections.

8. A magnetron cathode structure as claimed in claim 7, wherein said second end extends for a distance of 7 mm.

9. A magnetron cathode structure as claimed in claim 6, wherein each of said buffer members is funnel shaped and is formed of thin metal.

10. A magnetron cathode structure as claimed in claim 7, further comprising an insulating resin member coated over said second end.

11. A magnetron cathode structure comprising:

a ceramic plate member having first and second parallel openings therethrough;

a first electrical lead passing through the first opening;

a second electrical lead passing through the second opening;

first and second metallized sections formed on a first plate surface of said plate member and electrically insulated from each other, and encircling said first and second electrical leads, respectively;

a third metallized section formed on a second plate surface of said plate member and electrically insulated from said first and second electrical leads to cause said first and third metallized sections to form electrodes of a first condenser and said second and third metallized sections to form electrodes of a second condenser;

a first resilient metal buffer member sealing said first lead to said first metallized section for absorbing thermal stress resulting from a difference in the coefficients of thermal expansion of said first metallized section and said ceramic plate member;

a second resilient metal buffer member sealing said second lead to second metallized section for absorbing thermal stress resulting from a difference in the coefficients of thermal expansion of said second metallized section and said ceramic plate member; and a metallic outer frame member sealed to said third metallized sections.

12. A magnetron cathode structure as claimed in claim 11, wherein said ceramic plate member has a height of at least 7 mm.

* * * * *